US011642768B2

(12) United States Patent
Bendorf et al.

(10) Patent No.: US 11,642,768 B2
(45) Date of Patent: May 9, 2023

(54) DEAD BLOW HAMMER HEAD

(71) Applicant: Snap-on Incorporated, Kenosha, WI (US)

(72) Inventors: Scott A. Bendorf, Kenosha, WI (US); Jonathan I. Andersen, Mt. Pleasant, WI (US)

(73) Assignee: Snap-on Incorporated, Kenosha, WI (US)

( * ) Notice: Subject to any disclaimer, the term of this patent is extended or adjusted under 35 U.S.C. 154(b) by 0 days.

(21) Appl. No.: 16/929,553

(22) Filed: Jul. 15, 2020

(65) Prior Publication Data

US 2022/0016752 A1 Jan. 20, 2022

(51) Int. Cl.
*B25D 1/12* (2006.01)

(52) U.S. Cl.
CPC ..... *B25D 1/12* (2013.01)

(58) Field of Classification Search
None
See application file for complete search history.

(56) References Cited

U.S. PATENT DOCUMENTS

| | | | | |
|---|---|---|---|---|
| 2,451,217 | A | 10/1948 | Heinrich | |
| 2,750,194 | A | 6/1956 | Clark | |
| 3,088,506 | A * | 5/1963 | Bianchini | B25D 1/12 81/19 |
| 3,172,438 | A * | 3/1965 | Gianelli | B25D 1/02 81/22 |
| 3,303,863 | A | 2/1967 | Titchnell | |
| 3,907,292 | A | 9/1975 | Moreland | |
| 3,948,301 | A | 4/1976 | Hays | |
| 4,039,012 | A * | 8/1977 | Cook | B25D 1/02 81/22 |
| 4,330,125 | A | 5/1982 | Sassler | |
| 5,121,922 | A | 6/1992 | Harsh, Sr. | |
| 5,408,902 | A | 4/1995 | Burnett | |
| 5,613,916 | A | 3/1997 | Sommer | |
| 6,234,048 | B1 | 5/2001 | Carmien | |
| 6,595,087 | B2 | 7/2003 | Whalen et al. | |
| 6,983,674 | B1 | 1/2006 | Rufolo, Jr. | |
| 8,296,984 | B2 | 10/2012 | Kincel | |
| 8,943,726 | B2 | 2/2015 | Kincel | |

(Continued)

FOREIGN PATENT DOCUMENTS

| | | |
|---|---|---|
| CN | 106142012 A | 11/2016 |
| CN | 206690024 U | 12/2017 |

(Continued)

OTHER PUBLICATIONS

Taiwan Office Action for corresponding TW Application No. 110125730, dated Jan. 12, 2022, 10 pages.
Combined Search and Examination Report for Application No. GB2109106.1 dated Apr. 11, 2022, 11 pages.
Examination Report for corresponding Application No. GB2109106.1 dated Sep. 30, 2022, 6 pages.

(Continued)

*Primary Examiner* — Brian D Keller
(74) *Attorney, Agent, or Firm* — Seyfarth Shaw LLP

(57) ABSTRACT

A hammer head with an internal cavity including weights that are sized to restrict the weights from escaping from a crack in the hammer or are easily collected and accounted for should the hammer separate to ensure foreign objects and debris do not contaminate sensitive work spaces. The weights are shaped to allow the weights to longitudinally move in the internal cavity. The weights may take the form of a number of different shapes.

6 Claims, 4 Drawing Sheets

(56) References Cited

U.S. PATENT DOCUMENTS

| | | | | |
|---|---|---|---|---|
| 9,016,171 | B2 | 4/2015 | Chen | |
| 9,408,428 | B2 | 8/2016 | Gaudet | |
| 9,964,170 | B2 | 5/2018 | Gaudet | |
| 10,054,378 | B2 | 8/2018 | Pawlowski | |
| 10,208,828 | B2 | 2/2019 | Gaudet | |
| 10,415,907 | B1 | 9/2019 | Kincel et al. | |
| 2007/0113709 | A1 | 5/2007 | Krallman | |
| 2010/0251587 | A1 | 10/2010 | Kincel | |
| 2013/0213583 | A1* | 8/2013 | Jensen | B60C 25/02 157/5 |
| 2014/0216210 | A1* | 8/2014 | Near | B25D 1/02 81/25 |
| 2014/0352498 | A1* | 12/2014 | Liao | B25D 1/02 81/26 |
| 2018/0223939 | A1 | 8/2018 | Gaudet | |
| 2019/0136939 | A1 | 5/2019 | Gaudet | |
| 2020/0078916 | A1 | 3/2020 | Doner | |

FOREIGN PATENT DOCUMENTS

| | | | |
|---|---|---|---|
| DE | 1277769 | B | 9/1968 |
| DE | 8213740 | U1 | 9/1982 |
| DE | 102009058582 | A1 | 6/2011 |
| TW | 303777 | | 4/1997 |
| TW | M420399 | | 1/2012 |
| WO | 2006024114 | A1 | 3/2006 |

OTHER PUBLICATIONS

Taiwan Office Action for corresponding Application No. 11120669080 dated Jul. 8, 2022, 14 pages.

Taiwan Office Action for corresponding Application No. 11220185320 dated Mar. 1, 2023, 8 pages.

Combined Search and Examination Report for corresponding Application No. GB2211736.0 dated Feb. 13, 2023, 7 pages.

* cited by examiner

DEAD BLOW HAMMER HEAD

TECHNICAL FIELD OF THE INVENTION

The present invention relates generally to hammers. More particularly, the present invention relates to dead blow hammer heads having dampening material disposed inside.

BACKGROUND OF THE INVENTION

Hammer heads are well known tools for striking a work piece. Hammer heads are coupled to the end of a handle and swung towards the work piece to impart an impacting blow. A hammer head can include a striking face that strikes the work piece and, upon impact, drives the work piece into a working surface. The force felt by the user upon impact is often referred to as a "rebound" that skilled artisans have worked to dampen.

Dead blow hammer heads often include an internal cavity partially filled with "shot" or other flowable material that dampens the rebound force of the hammer. For example, the flowable material acts on the hammer head after the hammer head has impacted a work piece to impart a force opposing the rebound motion and "deaden" the rebound of the hammer. However, in sensitive environments, these hammers cannot be used because in the event the internal cavity is breached, the flowable material can escape.

SUMMARY OF THE INVENTION

The present invention relates broadly to a hammer head with an internal cavity including weights that are sized to confine the weights from escaping from a crack in the hammer, or are otherwise easily collected and accounted for should the hammer separate to ensure foreign objects and debris do not contaminate sensitive work spaces. In an example, the weights are weighted discs that slide longitudinally along a guide rod in the internal cavity. In this example, the weights can be shaped as flat discs or other shapes to closely fill a cross section of the internal cavity. The discrete weights may have at least one hole for an axial guide rod that restricts the weights from binding in the internal cavity. The combined height for all of the weights is also less than the overall length of the internal cavity, thus allowing the weights to slide along the axis of the guide rod to provide the dead-blow effect.

In another example, weights are longitudinally aligned spherical masses. In this example, the diameter of the spherical weights is less than a smallest dimension of the cross section of the internal cavity. The total height of all of the spherical weights is also less than the length of the internal cavity.

In an embodiment, the invention relates to a hammer head that includes a body having first and second ends, an end cap coupled to the second end, and an internal cavity formed in the body and having a longitudinal axis. A guide rod is disposed in the internal cavity and extends longitudinally along the longitudinal axis. A weight including a through hole is disposed in the internal cavity and the guide rod extends through the through hole.

In another embodiment, the invention relates to a hammer head that includes a body having first and second ends, an end cap coupled to the second end, and an internal cavity formed in the body, and having a longitudinal axis. Weights are disposed in the internal cavity and stacked linearly along the longitudinal axis.

In yet another embodiment, the invention relates to a hammer head that includes a body having first and second ends, an end cap coupled to the second end, and an internal cavity formed in the body, and having a longitudinal axis. Weights are longitudinally disposed in the internal cavity, and each of the weights includes a deformable end.

BRIEF DESCRIPTION OF THE DRAWINGS

For the purpose of facilitating an understanding of the subject matter sought to be protected, there is illustrated in the accompanying drawing embodiments thereof, from an inspection of which, when considered in connection with the following description, the subject matter sought to be protected, its construction and operation, and many of its advantages, should be readily understood and appreciated.

DETAILED DESCRIPTION

Figure 1:
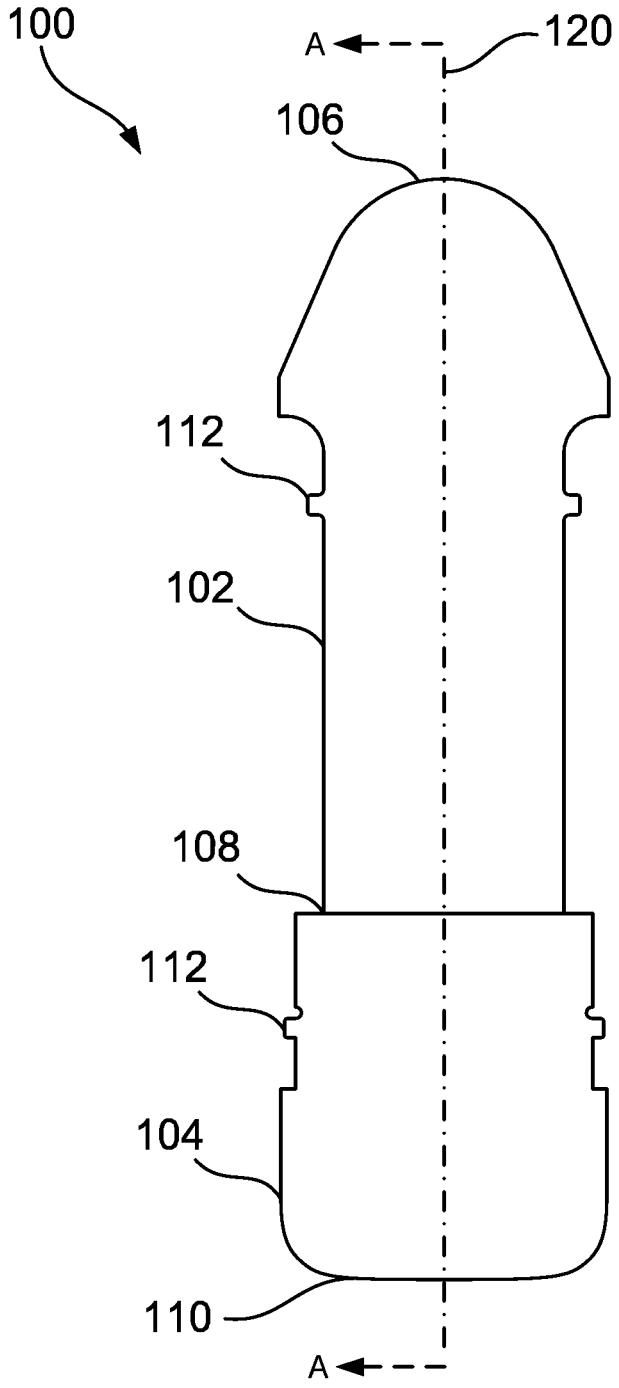
FIG. 1 is a plan view showing the exterior of an exemplar hammer head, according to an embodiment of the present invention.

While this invention is susceptible of embodiments in many different forms, there is shown in the drawings, and will herein be described in detail, a preferred embodiment of the invention with the understanding that the present disclosure is to be considered as an exemplification of the principles of the invention and is not intended to limit the broad aspect of the invention to embodiments illustrated. As used herein, the term "present invention" is not intended to limit the scope of the claimed invention and is instead a term used to discuss exemplary embodiments of the invention for explanatory purposes only.

The present invention broadly comprises a hammer head with an internal cavity including weights that are sized to restrict the weights from escaping from a crack in the hammer or are easily collected and accounted for should the hammer separate to ensure foreign objects and debris do not contaminate sensitive work spaces. The weights are shaped to allow the weights to longitudinally move in the internal cavity to provide a dead-blow effect. The weights may take the form of a number of different embodiments. For example, in one example, the weights can be shaped as long, thin rods. The lengths of the rods are less than a length of the internal cavity, and the rod geometry is chosen to maximize packing efficiency based on the size and shape of the internal cavity. Further, the rods may be tapered or rounded at the ends to allow for deformation of the ends after striking the ends of the internal cavity.

In another example, the weights are weighted discs that longitudinally slide along a guide rod in the internal cavity to provide the dead-blow effect. In this example, the weights can be shaped as flat discs or other shapes to closely fill a cross section of the internal cavity. The discrete weights may have at least one hole for an axial guide rod that restricts the weights from binding in the internal cavity. The combined height or length for all of the weights is also less than the length of the internal cavity.

In another example, the weights are longitudinally aligned spherical weights. In this example, the diameter of the spherical weights is less than a smallest dimension of the cross section of the internal cavity to allow the weights to move longitudinally within the cavity to provide the dead-blow effect. The total length of all of the spherical weights combined is also less than the length of the internal cavity to provide a space for the weights to longitudinally move.

Referring to FIG. 1, an embodiment of the present invention includes a hammer head 100. It will be appreciated that the embodiment of the hammer head 100 shown in FIG. 1 is usable with the different weight embodiments discussed herein, which is why, for example, the above Figure descriptions of the different embodiments of the weights reference FIG. 1 for purposes of cross-sections. The hammer head 100 includes a body 102 and an end cap 104 coupled to the body 102. The body 102 may include a first end 106 having a conical type shape that is used for striking a work piece and driving the work piece into a working surface. For example, the first end 106 may be used in situations where a work piece is located within a recess or in situations in which a ball point hammer or similar tool would be used.

The end cap 104 is coupled to a second end 108 of the body opposite the first end 106. The end cap 104 may include a substantially straight striking surface 110 that is used for striking a work piece and driving the work piece into a working surface. The end cap 104 may be coupled to the body 102 in a variety of different manners. For example, the end cap 104 may be coupled to the body 102 via a threaded connection, a friction/interference fit, a weld, an adhesive, etc. In some embodiments, it may be desirable to have the end cap 104 releasably coupled to the second end so that it is removeable and capable of being re-coupled to the body 102, to allow, for example, user interchangeability of weights (e.g., weights of different masses could be selected by a user for incorporation in the hammer head to achieve a desired dead-blow effect). In these situations, a threaded connection or friction/interference fit may be desirable.

The hammer head 100 may also be coupled to a handle in a known manner. For example, the hammer body may include one or more protrusions or ribs 112 that may assist in coupling the hammer head 100 to the handle.

Figure 4:
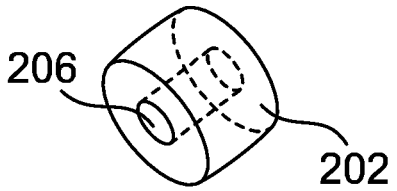
FIG. 4 is a perspective view of an exemplar weight of the hammer head of FIG. 2 according to an embodiment of the present invention.
Figure 3:
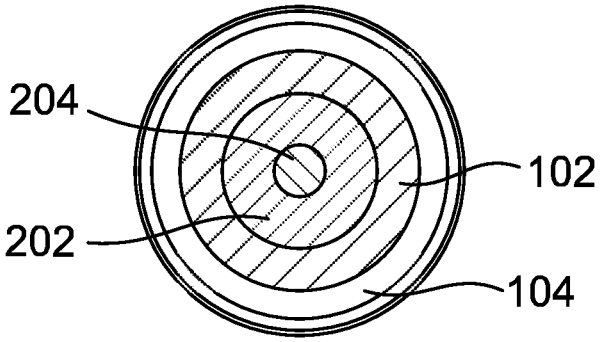
FIG. 3 is a cross sectional view of the hammer head taken perpendicular to a longitudinal axis of the hammer head of FIG. 2 according to an embodiment of the present invention.
Figure 2:
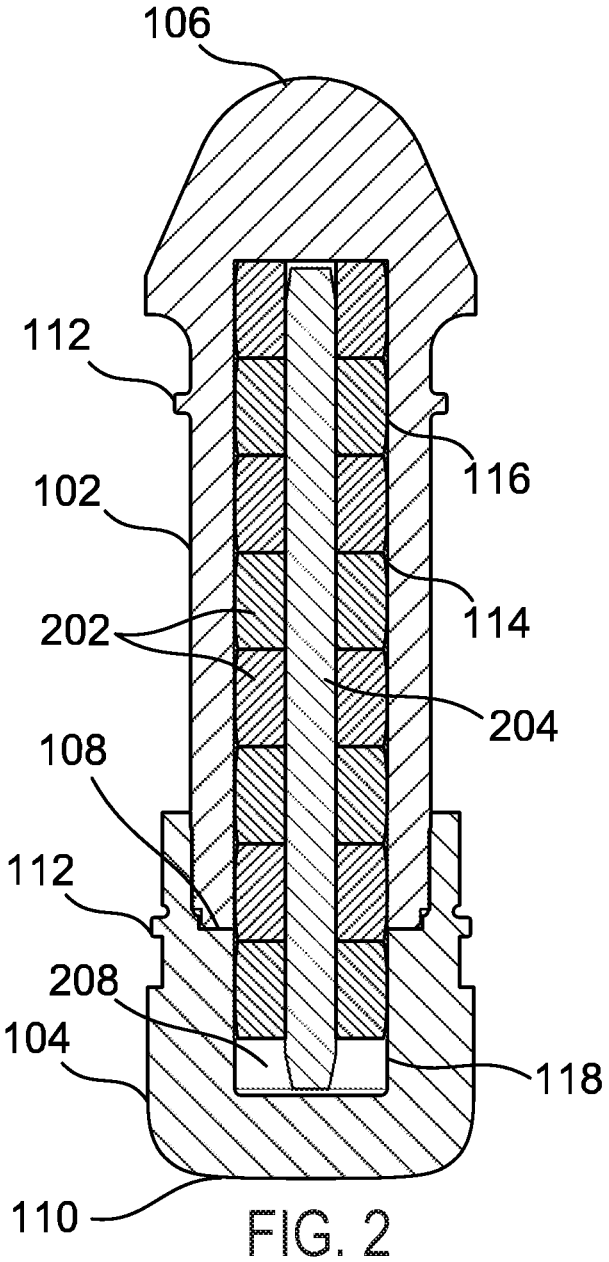
FIG. 2 is a cross sectional view of the hammer head taken along line A-A of FIG. 1, and including disc shaped weights according to an embodiment of the present invention.

The hammer head 100 may also include an internal cavity adapted to receive discrete weights that dampen or absorb a rebound force of the hammer head 100 when the hammer head 100 is used to strike a work piece, which is known as the dead-blow effect. In an embodiment, as shown in FIGS. 2-4, the hammer head 100 includes an internal cavity 114 formed by a first axial bore 116 extending from the second end 108 of the body 102 in a direction towards the first end 106, and a second axial bore 118 extending into the end cap 104 and extending in a direction towards the striking surface 110. The internal cavity has a length extending substantially along a longitudinal axis 120 (illustrated in FIG. 1) of the hammer head 100, and a cross sectional size (which may be a width or diameter) extending substantially perpendicular to the longitudinal axis 120.

In this embodiment, one or more discrete weights 202 are disposed in the internal cavity 114, and are adapted to slide longitudinally along a guide rod 204 disposed in the internal cavity 114 to provide the dead-blow effect. Each of the weights 202 can be shaped as a flat disc or other shape that corresponds to a cross sectional shape of the internal cavity 114 to closely fill a cross section of the internal cavity 114. Each of the weights 202 may also include at least one through hole 206 through which the guide rod 204 extends.

The guide rod 204 may have a length substantially corresponding to the length of the internal cavity 114 to restrict axial movement of the guide rod 204 with respect to the hammer head 100. The guide rod 204 may also guide axial movement of the weights 202 within the internal cavity 114, and restrict the weights 202 from binding in the internal cavity 114. A plurality of weights 202 may be disposed in the internal cavity 114, and a combined height or length for all of the weights 202 is less than the length of the internal cavity 114 to form a gap 208 between the combined height or length for all of the weights 202 and an end of the internal cavity 114. This gap 208 allows the weights 202 to move longitudinally along the guide rod 204 within the internal cavity 114 to provide the dead-blow effect when the hammer head 100 is used to strike a work piece.

While the cross sectional shapes of the internal cavity 114 and the weights 202 are illustrated as circular, the cross sectional shapes can be square, rectangular, triangular, or any other shape. The weights 202 are also sized to restrict the weights 202 from escaping from a crack in the hammer head 100 or are easily collected and accounted for should the hammer head 100 separate to ensure foreign objects and debris do not contaminate sensitive work spaces. For example, as illustrated in FIG. 2, eight weights 202 are linearly arranged relative to each other. However, it should be appreciated that more or less than eight weights 202 may be used depending on the size of the internal cavity 114. Moreover, it will be appreciated that if the end cap is removable from the hammer head 100, then user adjustment of the number and/or mass of the weights in the internal cavity 114 can be made to obtain the desired dead-blow effect.

Figure 6:
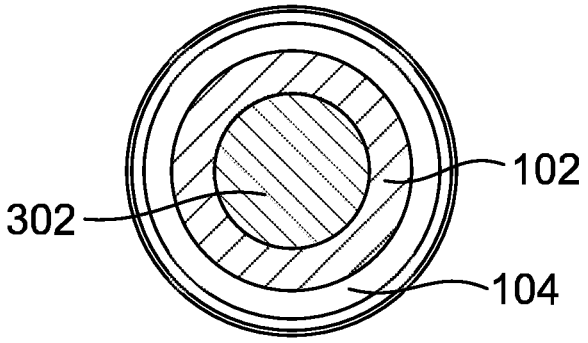
FIG. 6 is a cross sectional view of the hammer head taken perpendicular to a longitudinal axis of the hammer head of FIG. 5 according to an embodiment of the present invention.
Figure 5:
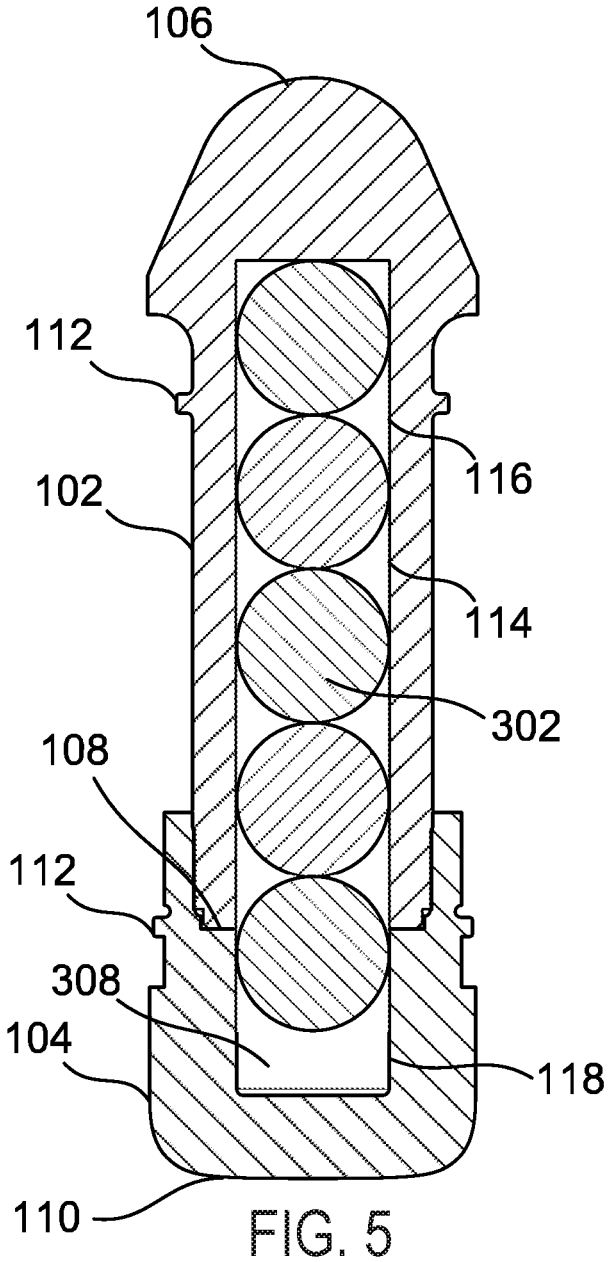
FIG. 5 is a cross sectional view of the hammer head taken along line A-A of FIG. 1, and including spherical shaped weights according to another embodiment of the present invention.

In another embodiment, referring to FIGS. 5 and 6, one or more discrete weights 302 are disposed in the internal cavity 114, and are adapted to move longitudinally in the internal cavity 114. Each of the weights 302 can be shaped as a spherical ball or other shape that corresponds to a cross sectional shape of the internal cavity 114 to closely fill a cross section of the internal cavity 114. A plurality of weights 302 may be disposed in the internal cavity 114, and a combined height or length for all of the weights 302 is less than the length of the internal cavity 114 to form a gap 308 between the combined height or length for all of the weights 302 and an end of the internal cavity 114. This gap 308 allows the weights 302 to move longitudinally within the internal cavity 114 to provide the dead-blow effect when the hammer head 100 is used to strike a work piece.

While the cross sectional shapes of the internal cavity 114 and the weights 302 are illustrated as circular, the cross sectional shapes can be square, rectangular, triangular, or any other shape. The weights 302 are also sized to restrict the weights 302 from escaping from a crack in the hammer head 100 or are easily collected and accounted for should the hammer head 100 separate to ensure foreign objects and debris do not contaminate sensitive work spaces. For example, as illustrated in FIG. 5, five weights 302 are linearly arranged relative to each other. However, it should be appreciated that more or less than five weights 302 may be used depending on the size of the internal cavity 114. Moreover, it will be appreciated that if the end cap is removable from the hammer head 100, then user adjustment of the number and/or mass of the weights in the internal cavity 114 can be made to obtain the desired dead-blow effect.

Figure 9:
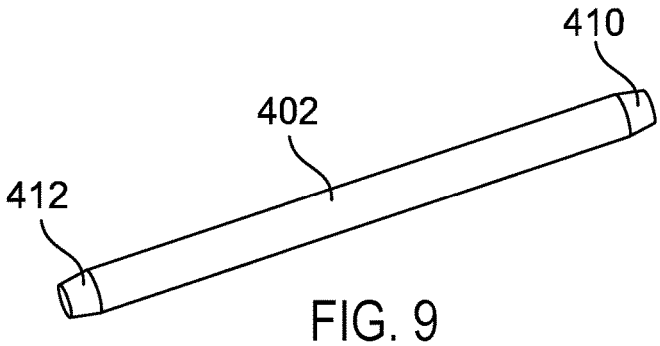
FIG. 9 is a perspective view of a weight of the hammer head of FIG. 7 according to an embodiment of the present invention.
Figure 8:
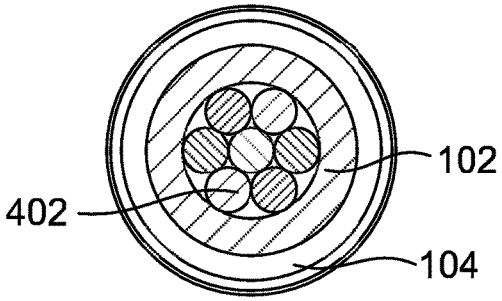
FIG. 8 is a cross sectional view of the hammer head taken perpendicular to a longitudinal axis of the hammer head of FIG. 7 according to an embodiment of the present invention.
Figure 7:
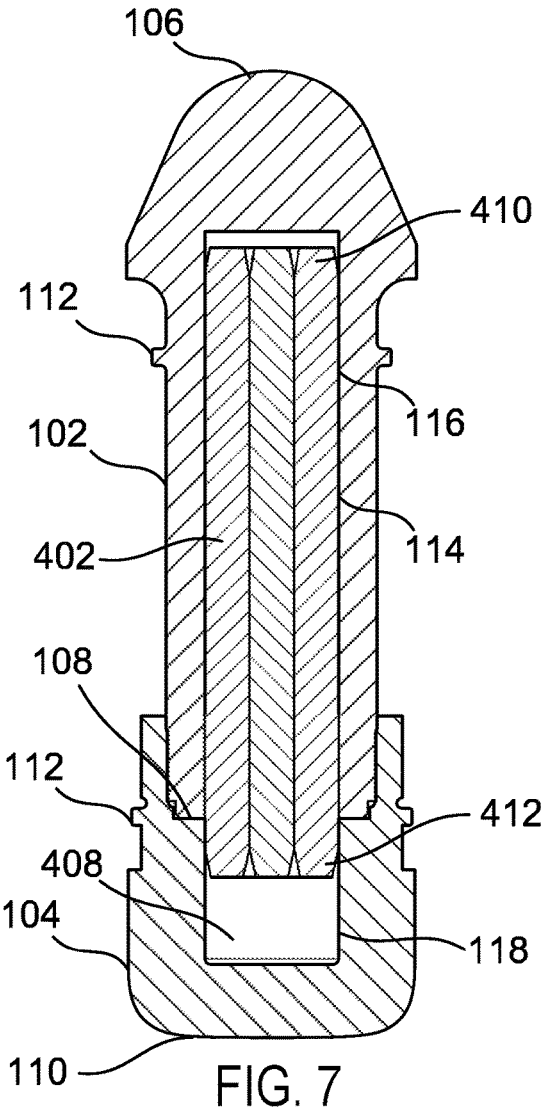
FIG. 7 is a cross sectional view of the hammer head taken along line A-A of FIG. 1, and including longitudinal rod shaped weights according to another embodiment of the present invention.

In yet another embodiment, referring to FIGS. 7-9, one or more discrete weights 402 are disposed in the internal cavity 114, and are adapted to move longitudinally in the internal cavity 114. Each of the weights 402 can be shaped as a long, thin rod. The length of each of the weight 402 is less than the length of the internal cavity 114 to form a gap 408 between ends of the weights 402 and an end of the internal cavity 114. This gap 308 allows the weights 402 to move longitudinally within the internal cavity 114 to provide the dead-blow effect when the hammer head 100 is used to strike a work piece.

A cross sectional geometry of each weight 402 may also be selected to maximize packing efficiency based on the size and shape of the internal cavity 114, and closely fill a cross section of the internal cavity 114. For example, the cross sectional shape of each of the weights 402 may be circular, and sized to allow for six weights 402 to be disposed in the internal cavity 114 and form a circular arrangement, and one additional weight 402 (making seven total) to be disposed centrally between the six weights 402.

Further, each of the weights 402 may also have opposing first and second ends 410 and 412. The first and second ends 410 and 412 may be tapered or rounded to allow for deformation of the first and second ends 410 and 412 after striking the ends of the internal cavity 114. In this embodiment, it may be desirable to have the end cap 104 be removable from the body 102 (as described above) to allow for replacement of the weights 402.

While the cross sectional shapes of the internal cavity 114 and the weights 402 are illustrated as circular, the cross sectional shapes can be square, rectangular, triangular, or any other shape. The weights 402 are also sized to restrict the weights 402 from escaping from a crack in the hammer head 100 or are easily collected and accounted for should the hammer head 100 separate to ensure foreign objects and debris do not contaminate sensitive work spaces. For example, as illustrated in FIG. 7, seven weights 402 are disposed longitudinally in the internal cavity 114, and next to one another. However, it should be appreciated that more or less than seven weights 402 may be used depending on the size of the internal cavity 114. Moreover, it will be appreciated that if the end cap is removable from the hammer head 100, then user adjustment of the number and/or mass of the weights in the internal cavity 114 can be made to obtain the desired dead-blow effect.

As used herein, the term "coupled" and its functional equivalents are not intended to necessarily be limited to direct, mechanical coupling of two or more components. Instead, the term "coupled" and its functional equivalents are intended to mean any direct or indirect mechanical, electrical, or chemical connection between two or more objects, features, work pieces, and/or environmental matter. "Coupled" is also intended to mean, in some examples, one object being integral with another object. As used herein, the term "a" or "one" may include one or more items unless specifically stated otherwise.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of the inventors' contribution. The actual scope of the protection sought is intended to be defined in the following claims when viewed in their proper perspective based on the prior art.

What is claimed is:

1. A hammer head having a longitudinal axis, the hammer head comprising:

a body adapted to be coupled to a handle, the body having opposing first and second ends and a first axial bore extending into the body from the second end in a direction towards the first end, wherein the first end is adapted to impact a work piece;

an end cap coupled to the second end and including a second axial bore extending into the end cap;

a continuous internal cavity formed by the first and second axial bores, wherein the internal cavity has a cavity length extending along the longitudinal axis;

a guide rod disposed in the internal cavity and extending along the longitudinal axis, wherein the guide rod has a guide rod length that substantially corresponds to the cavity length to restrict axial movement of the guide rod in the internal cavity; and a weight including a through hole, wherein the weight is disposed in the internal cavity and the guide rod extends through the through hole, wherein the weight is longitudinally moveable in each of the first and second axial bores along the guide rod.

2. The hammer head of claim 1, wherein the weight has a shape that substantially corresponds to a cross sectional shape of the internal cavity.

3. The hammer head of claim 1, wherein the weight includes more than one weight, and a combined length of the weights is less than the cavity length.

4. The hammer head of claim 1, wherein the weight includes more than one weight, and the weights are linearly arranged along the longitudinal axis.

5. The hammer head of claim 1, wherein the weight is substantially disc shaped.

6. The hammer head of claim 1, wherein the end cap is releasably coupled to the second end.

* * * * *